US011130625B2

(12) United States Patent
Ledoux et al.

(10) Patent No.: US 11,130,625 B2
(45) Date of Patent: Sep. 28, 2021

(54) SELF-STORAGE FACILITY, FABRICATION, AND METHODOLOGY

(71) Applicant: STORAGE IP LLC, Houston, TX (US)

(72) Inventors: David Wayne Ledoux, Houston, TX (US); Richard Waldon Stockton, Jr., Houston, TX (US)

(73) Assignee: Storage IP LLC, Houston, TX (US)

( * ) Notice: Subject to any disclaimer, the term of this patent is extended or adjusted under 35 U.S.C. 154(b) by 0 days.

(21) Appl. No.: 16/346,288

(22) PCT Filed: Oct. 31, 2017

(86) PCT No.: PCT/US2017/059397
§ 371 (c)(1),
(2) Date: Apr. 30, 2019

(87) PCT Pub. No.: WO2018/085297
PCT Pub. Date: May 11, 2018

(65) Prior Publication Data

US 2019/0257073 A1 Aug. 22, 2019

Related U.S. Application Data

(60) Provisional application No. 62/415,508, filed on Nov. 1, 2016.

(51) Int. Cl.
*E04B 1/348* (2006.01)
*B65D 88/02* (2006.01)
(Continued)

(52) U.S. Cl.
CPC ..... *B65D 88/022* (2013.01); *B65D 88/005* (2013.01); *B65D 88/027* (2013.01);
(Continued)

(58) Field of Classification Search
CPC ..... B65D 88/022; B65D 90/0006; B65D 88/005; B65D 90/008; B65D 88/027; E04B 1/3483; E04B 2001/34892
See application file for complete search history.

(56) References Cited

U.S. PATENT DOCUMENTS 2,963,310 A 12/1960 Abolins
3,323,655 A 6/1967 Foran et al.
(Continued)

FOREIGN PATENT DOCUMENTS

AU 2013205213 A1 1/2014
DE 2006018830 U1 5/2007
(Continued)

OTHER PUBLICATIONS

International Search Report, Application No. PCT/US2017/059397 (dated Jan. 26, 2018).
(Continued)

*Primary Examiner* — Andrew J Triggs
(74) *Attorney, Agent, or Firm* — Carrington, Coleman, Sloman & Blumenthal, L.L.P.

(57) ABSTRACT

A self-storage facility. The facility comprises a plurality of commercial containers located at a single facility. The facility further comprises at least one dividing wall within an interior of each of the plurality of containers, thereby separating the interior into a plurality of storage volumes. The facility further comprises and least one access mechanism for each of the plurality of storage volumes.

20 Claims, 15 Drawing Sheets

(51) Int. Cl.
*B65D 90/00* (2006.01)
*B65D 88/00* (2006.01)

(52) U.S. Cl.
CPC ..... *B65D 90/0006* (2013.01); *B65D 90/008* (2013.01); *E04B 2001/34892* (2013.01)

(56) References Cited

U.S. PATENT DOCUMENTS

| | | | | |
|---|---|---|---|---|
| 3,638,380 | A | 2/1972 | Perri | |
| 3,748,793 | A | 7/1973 | Tompkins | |
| 3,792,558 | A | 2/1974 | Berce | |
| 3,925,679 | A | 12/1975 | Berman et al. | |
| 4,364,206 | A | 12/1982 | Wybauw | |
| 4,599,829 | A | 7/1986 | DiMartino, Sr. | |
| 4,644,708 | A | 2/1987 | Baudot et al. | |
| 4,854,094 | A | 8/1989 | Clark | |
| 4,950,114 | A | 8/1990 | Borchardt | |
| 4,993,125 | A | 2/1991 | Capron et al. | |
| 5,165,757 | A | 11/1992 | MacDonald | |
| 5,735,639 | A | 4/1998 | Payne et al. | |
| 6,973,758 | B2 | 12/2005 | Zeik et al. | |
| 7,823,338 | B2 * | 11/2010 | Slagel | E04H 1/1205 52/79.1 |
| 7,827,738 | B2 | 11/2010 | Abrams et al. | |
| 8,474,132 | B2 | 7/2013 | Li et al. | |
| 8,484,929 | B1 * | 7/2013 | Begdouri | E02D 29/045 52/745.03 |
| 8,763,314 | B2 | 7/2014 | Yoo | |
| 8,769,886 | B2 | 7/2014 | Ohnishi et al. | |
| 8,833,001 | B2 | 9/2014 | Gardner | |
| 8,910,439 | B2 * | 12/2014 | Ingjaldsdottir | E04H 1/005 52/309.16 |
| 8,991,134 | B2 | 3/2015 | Wheeler | |
| 9,121,168 | B2 | 9/2015 | Levy et al. | |
| 9,631,359 | B2 | 4/2017 | Malakauskas | |
| 9,663,962 | B1 * | 5/2017 | Whittemore | E04G 21/243 |
| 10,280,608 | B2 * | 5/2019 | Ledoux | E04B 1/3483 |
| 10,876,283 | B2 | 12/2020 | Ledoux et al. | |
| 2001/0035410 | A1 * | 11/2001 | Taube | B65D 88/005 220/1.5 |
| 2002/0104838 | A1 | 8/2002 | Minkkinen | |
| 2002/0129566 | A1 * | 9/2002 | Piccolo | E04H 5/02 52/79.1 |
| 2005/0055891 | A1 | 3/2005 | Kuebler | |
| 2005/0055939 | A1 | 3/2005 | Wolgemuth et al. | |
| 2005/0279035 | A1 | 12/2005 | Donovan | |
| 2007/0271857 | A1 | 11/2007 | Heather et al. | |
| 2008/0250726 | A1 * | 10/2008 | Slagel | E04H 1/1205 52/79.8 |
| 2009/0031642 | A1 | 2/2009 | Donovan | |
| 2009/0101446 | A1 * | 4/2009 | Franchi | E04H 5/06 187/203 |
| 2009/0135015 | A1 | 5/2009 | Dobson et al. | |
| 2010/0024314 | A1 | 2/2010 | Pope | |
| 2010/0024353 | A1 | 2/2010 | Pope | |
| 2011/0011314 | A1 * | 1/2011 | Slagel | G01V 5/0008 109/23 |
| 2011/0016801 | A1 | 1/2011 | Ziegelman | |
| 2011/0016802 | A1 * | 1/2011 | Wallance | E04B 1/348 52/79.9 |
| 2011/0056147 | A1 | 3/2011 | Beaudet | |
| 2011/0146751 | A1 * | 6/2011 | McGuire | F03D 9/007 136/245 |
| 2011/0173907 | A1 | 7/2011 | Katsalidis | |
| 2014/0115976 | A1 * | 5/2014 | Lippert | E04H 1/005 52/79.2 |
| 2015/0240475 | A1 * | 8/2015 | Malakauskas | E04H 1/04 52/79.13 |
| 2015/0266616 | A1 | 9/2015 | Barrable et al. | |
| 2016/0090774 | A1 | 3/2016 | Reynolds | |
| 2016/0164560 | A1 | 6/2016 | Schell et al. | |
| 2016/0168844 | A1 | 6/2016 | Lago de Carvalho | |
| 2016/0222649 | A1 | 8/2016 | Baik | |
| 2018/0106030 | A1 * | 4/2018 | Ledoux | E04B 1/3483 |
| 2019/0226199 | A1 * | 7/2019 | Ledoux | B65D 88/022 |
| 2019/0257073 | A1 * | 8/2019 | Ledoux | B65D 88/022 |

FOREIGN PATENT DOCUMENTS

| | | | | |
|---|---|---|---|---|
| DE | 2009032325 | A1 | 1/2011 | |
| DE | 102014002480 | A1 | 8/2014 | |
| DE | 102013014686 | A1 | 3/2015 | |
| EP | 2738316 | A1 | 6/2014 | |
| FR | 2441703 | | 6/1980 | |
| GB | 2487650 | A | 8/2012 | |
| WO | 2015143566 | A1 | 10/2015 | |
| WO | 2016/164560 | | 10/2016 | |
| WO | WO-2016164560 | A1 * | 10/2016 | E04B 1/3483 |

OTHER PUBLICATIONS

Supplementary European Search Report, Application No. EP 16777264 (dated Oct. 25, 2018).

"Sanlitun South" by ARCH20, date not indicated but project year said to be 2008, (retrieved on Jan. 27, 2021) retrieved from the internet. <http://www.arch2o.com/sanlitun-south-lot-ek-architecture-and-design/>.

http://www.lot-ek.com/filter/commercial/PUMA-CITY, 2008.

* cited by examiner

SELF-STORAGE FACILITY, FABRICATION, AND METHODOLOGY

TECHNICAL FIELD

The preferred embodiments relate to self-storage facilities.

BACKGROUND ART

Self-storage facilities are prolific and include a number of associated storage units located at a single location, which may be indoor, outdoor, or a combination thereof and also may or may not include climate control. A typical facility rents or leases individual storage units, which may vary in size, configuration, and are often priced accordingly. Such facilities provide various benefits to various people, typically consumers in the general public. For example, an owner/renter/lessee of a unit is able to store and retrieve various items within their unit and access them over typically flexible times during the period of the agreement, subject to any additional limitations of the agreement. As another example, self-storage units provide additional storage flexibility to the user as they are able to store additional goods without a need to sell or otherwise lose access to such goods, while still supplementing whatever storage they have at their place of residence. Thus, keepsakes, valuables, hobby items, personal belongings and the like all may be retained without adding cost that might be associated with needing a larger place of residence.

While the above is well-established and has served both facility owners and users, existing single level and multi-level self-storage facilities can be expensive to design and build, and such costs may be passed on to consumers, developers, and investors. Advances in the industry have been fairly slow in the industry, for example with various areas such as the development of technology, intellectual property, and manners of improving the business both to the consumer as well as the owners and investors that develop, own, and maintain such facilities. The present inventors have recognized these drawbacks as well as others and, the preferred embodiments, therefore, seek to improve upon the prior art. Indeed, the preferred embodiments are directed at potentially revolutionary changes in the industry, including to the consumer and the environment, as well as from a commercial success analyses. Various aspects of various preferred embodiments may introduce a paradigm shift in the existence and consumer experience and expectation involving self-storage facilities.

DISCLOSURE OF INVENTION

In one preferred embodiment, there is a self-storage facility. The facility comprises a plurality of commercial containers located at a single facility. The facility further comprises at least one dividing wall within an interior of each of the plurality of containers, thereby separating the interior into a plurality of storage volumes. The facility further comprises and least one access mechanism for each of the plurality of storage volumes.

Numerous other aspects and preferred embodiments are described and claimed.

The preferred embodiments provide numerous benefits and advantages over the prior art, as will be appreciated by one skilled in the art by the teachings of this document. By way of introduction, a walk through a contemporary storage facility reveals a large number of storage units, typically of a few different size options (e.g., 5'×10', 10'×10', etc.), with varying sheets of materials forming front and side walls, and often some type of wire mesh or the like atop each unit. Multiple stories or levels of storage sometimes exist, with pillars and additional structural support required for such units. In contrast, the preferred embodiments provide considerable modularity and efficiency, in that existing devices (i.e., commercial shipping containers) are taken from what may be locations of overabundance and special requirements such as industrial zoning or the like, with modifications so as to reconfigure and repurpose such devices so as to serve a more efficient and beneficial construction of self-storage facilities, thereby improving the ecological (i.e., green) impact on society while also provide a valuable service and ability for personal storage in a way that may well revolutionize an entire and long-standing industry. Moreover, the preferred embodiments drastically reduce costs as compared to the prior art, in an industry that has had a long standing yet unaddressed and unresolved need for innovations such as any one or more of the above. Still further, by variably dividing the inner volume of each container, numerous different storage volumes may be achieved with a relatively low investment at the time of installation, and movable dividing walls permit relatively ease in volumetric configuration even after site development, thereby addressing accommodating the potential for change in consumer demand after a site is constructed. Numerous other benefits are described herein, and still others will be ascertainable by one skilled in the art.

BRIEF DESCRIPTION OF DRAWINGS

The preferred embodiments are described in detail below by referring to the accompanying drawings.

DESCRIPTION OF EMBODIMENTS

The preferred embodiments include located, positioned, and stacked shipping containers in a self-storage facility with various advantages, including the elimination of the need, cost, and time considerations involved in the typical prior art approach of building additional infrastructure to support multiple floors or levels in a self-storage building. The preferred embodiments also permit the reconfiguration and therefore in part repurposing of shipping containers as storage, while the reconfiguration, placement, and related features herein allow certain benefits, including volume, strength, and load bearing, are realized, while at the same time removing dormant, abundant shipping containers from other locations, where such containers may be unsightly or undesired. Moreover, the combinations involved in various preferred embodiments yield an overall reduction in the cost to manufacturing self-storage facilities, which savings can be shared among the various parties involved with the facility, including the customers that ultimately rent units within the facility.

Figure 1:
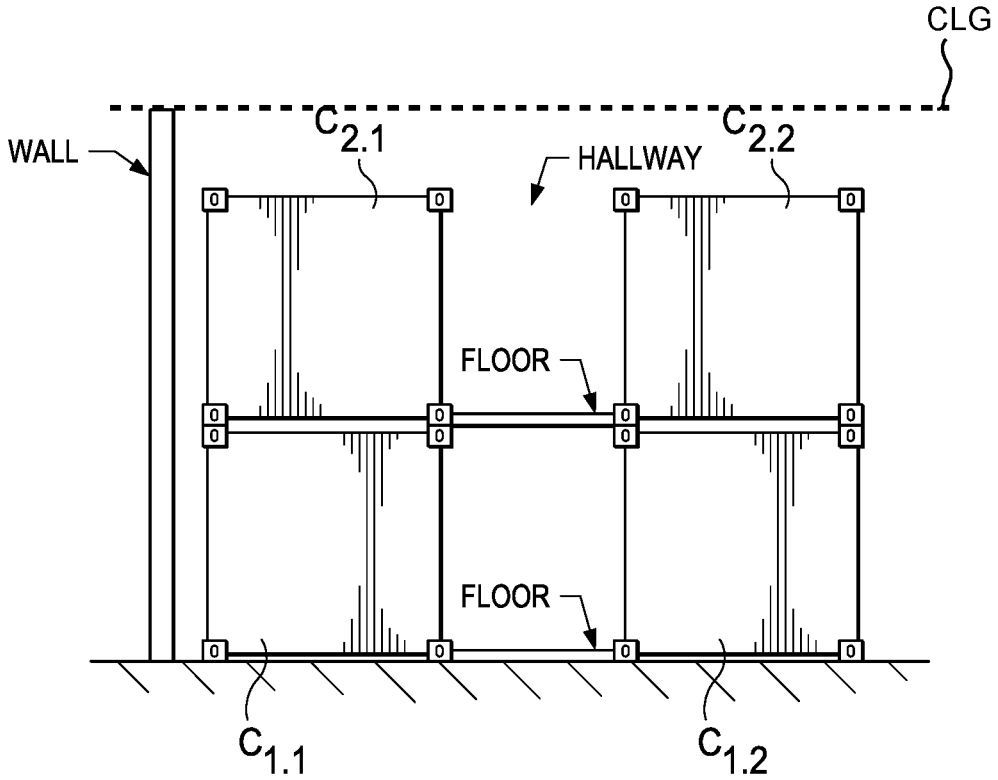
FIG. 1 illustrates a diagrammatic block diagram end and cross-sectional view of shipping containers arranged to serve as storage units in a storage facility, wherein a second level container sits directly atop a first level container, and wherein a floor is extended between proximate second level containers by way of affixation to each respective second level container bottom side rail.
Figure 2:
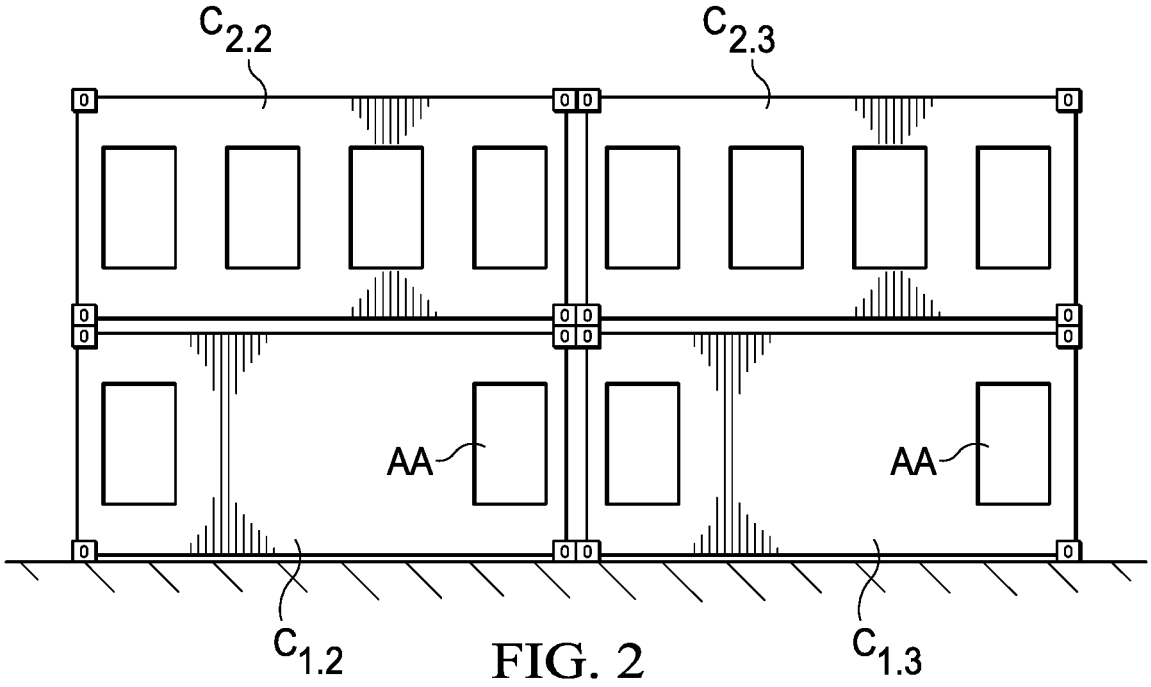
FIG. 2 illustrates a right side view of the illustration of FIG. 1.

In greater detail, various preferred embodiments combine existing commodities, namely, standard steel shipping or intermodal containers or the like (the "Container" or "Containers"), with an existing building structure or in an open area, and contemplate various arrangement and supplemental apparatus, in novel and inventive manners. Containers are typically manufactured from metal and used to transport goods by truck, rail, and shipping vessel. In the preferred embodiment, however, the Containers are stacked either on a substrate (e.g., ground) or on top of and/or beside each other, as shown in FIGS. 1 and 2. Specifically, FIG. 1 illustrates an end view, and FIG. 2 a side view, of various Containers $C_{1.1}$ through $C_{1.2}$ on a First Level, where each such Container is atop a first plane (e.g., the ground) and a Floor can be formed between Containers on a same Level, where a preferred embodiment floor structure is defined below, thereby creating a Hallway between parallel (along the major axis) Containers on a same Level. Moreover, given the First Level Containers, the second Level Containers $C_{2.1}$ and $C_{2.2}$ are located on the Second Level, thereby contacting and supported beneath by First Level Containers. In this regard, the existing outer structure of the individual Containers provide a general framework and load bearing function, and then additional preferred embodiment modifications are implemented so as to accommodate myriad possible storage sizes and configurations.

For example, a typical Container is on the order of 8×40 feet, so a number N1 of Containers may be positioned side-by-side along a same horizontal plane (e.g., a First Level floor), thereby providing a total volume of 8×40×N1 square feet of storage, albeit with the Container walls segregating each Container interior from the other. The preferred embodiments, however, contemplate selectively removing portions of such walls, as well as adding interior partitions or walls, so that in this example the 8×40×N1 square feet is readily re-partitioned into different units of different sizes. Moreover, the height of Containers may be selected from various existing or available sizes, thereby further providing an additional dimension calculation into total volume available for storage; indeed, as also detailed later, in one preferred embodiment a same Level may include Containers of different heights, with additional preferred embodiment apparatus to allow stacking of another Container Level atop the same-Level, yet differing height, Containers. Further, and as shown in FIG. 2, such as either Containers $C_{1.2}$ and $C_{1.3}$ on the First Level, or Containers $C_{2.2}$ and $C_{2.3}$ on the second Level, a number N2 (e.g., N2=2) of Containers may be positioned in a single line, thereby providing exterior walls and a ceiling that are 8×(40×N2) feet, and further permitting the addition of walls or other partitions inside the Containers so that an individual Container, nominally 8×40 on its exterior, may on its inside provide a number of segregated storage units. Also, some units may be aligned so that their major axis, that is, the axis along the longer dimension of the Container (i.e., the length) are parallel in side-by-side fashion or co-linear along a continuous line of two or more Containers, while others may have their major axis in a different (e.g., perpendicular) orientation to the major axis of other Containers. Thus, while not shown in FIG. 2, with Containers stacked on the First Level atop a first substrate (e.g., the ground), a Second Level of Containers are positioned atop the First Level Containers, with the positioning of the Second Level Containers being that the major axis of the Second Level Containers can be either in the same direction or perpendicular with respect to one another as well as with respect to the First Level Containers. The Containers can be set adjacent to a wall (See FIG. 1, Container $C_{1.1}$) and/or configured in such a way as to provide an outer boundary so that fall protection is also provided by such Containers in that access is only available to the Container from the side of the Container that opposes the outer perimeter wall of the container, such as in Second Level, that is, thereby allowing access only from the area that is within the outer perimeter of the overall configuration of Containers, so that the structure of the perimeter Containers also provide a barrier to falling or the like. Finally, while these and other Figures illustrate two Levels, the preferred embodiments further contemplate multiple levels beyond just two Levels.

As shown in other Figures, each Container is provided with one or more access apertures AA, some of which are labeled by way of example in FIG. 2, as may be a slidable door or the like (e.g., rollup-door), with the frame of the Container cut away so as to provide the aperture and appropriate hardware added so as to allow the aperture to be open and closed by a user (e.g., a movable door, member, or the like). Thus, such access doors or the like, installed in the arranged Containers, provide access to property stored therein. Moreover, in some preferred embodiments, the apertures are formed along the Container sidewall(s), whereas in others as detailed later, the apertures are formed at one or both ends of a Container.

Figure 3A:
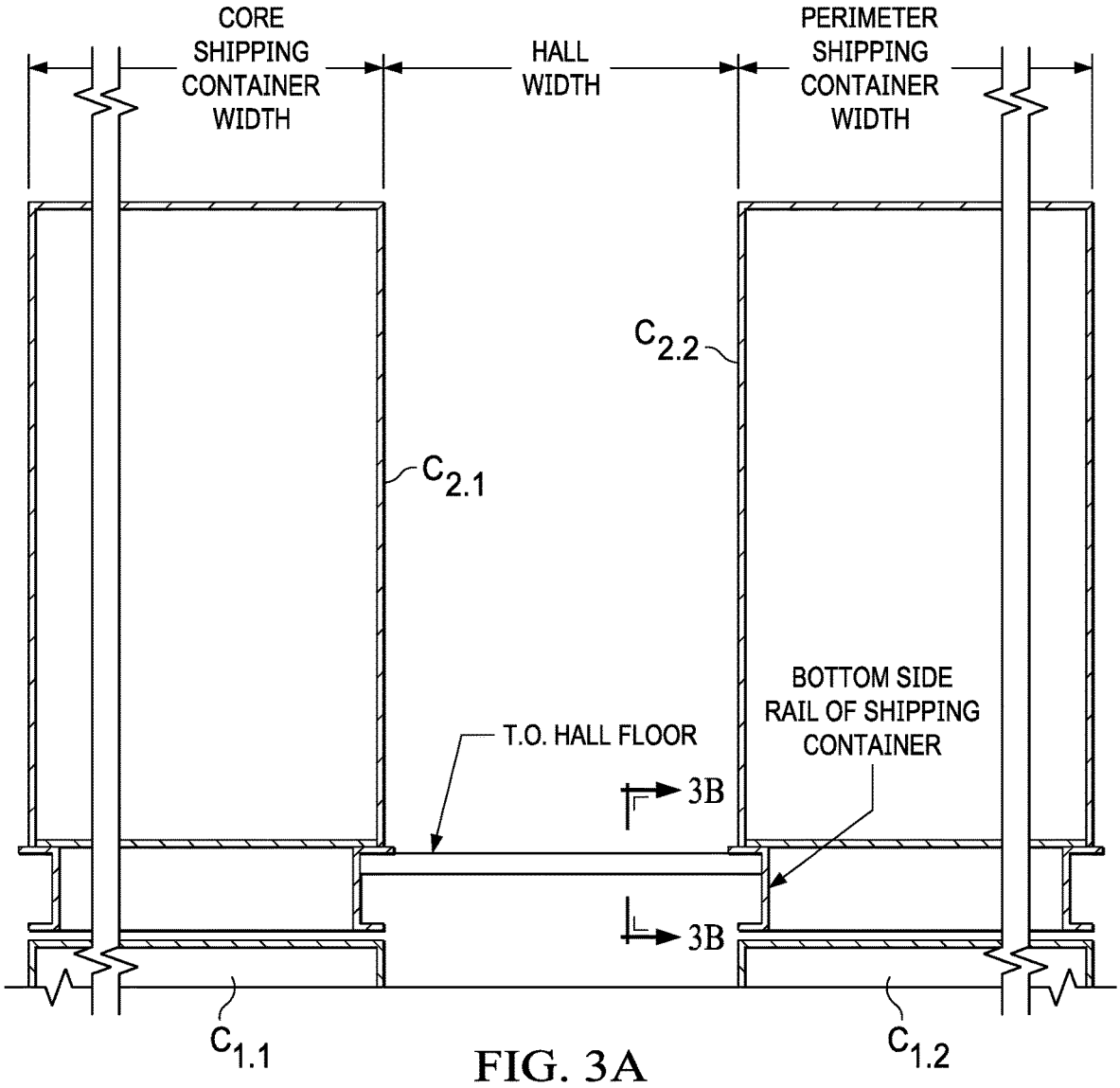
FIGS. 3A and 3B illustrates a sectional and partial view of FIG. 1 in greater detail, including a floor design using a respective bottom side rail of two containers at a same elevated level (e.g., second or higher).
Figure 3B:
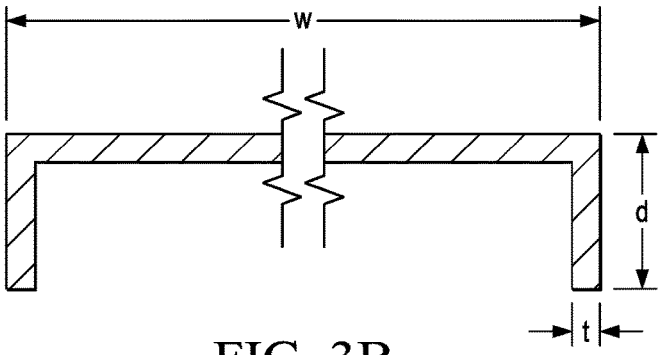

Also in the preferred embodiments, a first set of Containers are placed atop a substrate forming a first level of storage volume; and a second set of Containers is set atop the first set, forming a second level of storage volume (See FIGS. 3A and 3B). Also, in contrast to other preferred embodiment where a Container roof in a First Level can provide support for a walking surface for accessing an interior of at least one Container in the Second Level, in an alternative preferred embodiment flooring is achieved by creating a hallway substrate that spans between spaced-apart Containers on a same Level. As illustrated, for example, in FIG. 3A such a preferred embodiment is shown, where a Floor (see, also, FIG. 1) is provided, including 4'L-6'L steel planks, or other material, in widths of 12"-24", is attached via weld, or other method of attachment, to the upper flange of each spaced-apart Container's bottom side rail. These planks will be placed side by side whereby the length of each plank spans the width of the hallway (see, also, FIG. 4C). Once installed the planks are preferably covered by any number of materials for a suitable walking surface for customers to the self-storage facility, like carpet, concrete, plywood, etc. Thus, while the manufactured prior art intended purpose of the bottom side rails of the Container is to simply add structural support to the Container and to transfer loads to the rest of the structural members, the preferred embodiment further avails of the upper edge (or bezel) of the bottom side rail as a support to which each plank is attached and from which it extends, toward another Container and preferably to the upper edge of the bottom side rail of that other Container.

Figure 5:
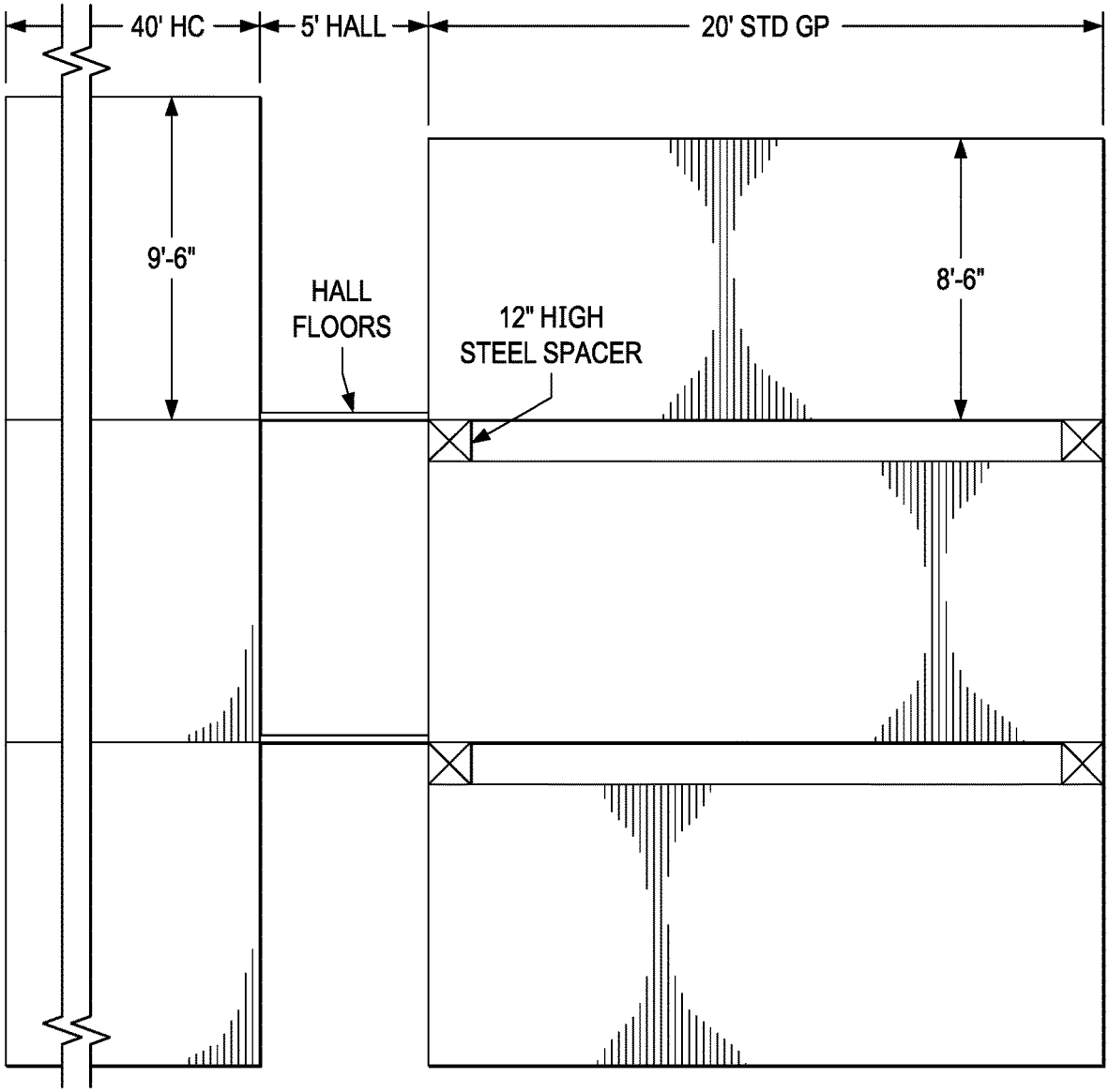
FIG. 5 illustrates the side view of containers of different heights with additional preferred embodiment structure so as to provide planar heights between separated containers and to facilitate like-height hallways flooring.

In another preferred embodiment and as introduced above, a preferred embodiment self-storage facility is composed of Containers on a same Level having differing heights. For example, one such preferred embodiment is shown in FIG. 5, where each Level is shown to the left of the Hallway to comprise Containers having a height of 9.5'H, where each Level is shown to the right of the Hallway to comprise Containers having a height of 8.5'H; thus, commercially available in some abundance now are 40' long "high-cube" Containers (HCC) with height of 9.5' (i.e., measuring 40'L×8'W×9.5'H), while the 20' long non-HCC (NHCC) Containers with height of 8.5' (i.e., measuring 20'L×8'W×8.5'H) are less available. However, note that the more abundant HCC Containers are twice the length, so this in addition to their abundance may lend to a larger number of HCC Container at a preferred embodiment self-storage facility, combined with fewer 20' NHCC Containers that are 1'H less tall than the 40'H HCC. The present inventors therefore recognize that, as a result, bottom side rails of a HCC will not be level with the bottom side-rails of a NHCC Container the Second and higher Levels, as the Containers are not the same height. In this preferred embodiment, therefore, 1'H corner blocks or spacers are welded or otherwise positioned at the top four corners of a lower level NHCC container so as to provide a 9.5" surface, atop which the corners of the next higher Level Container is located, thereby aligning the bottom rails of the next higher Level Containers along the same horizontal plane, despite those Containers being supported by Containers of differing heights in the immediately-lower level. With co-planar bottom rails as discussed, horizontal flooring may be constructed as taught above, as between the respective bottom rails of the spaced-apart Containers.

Figure 6:
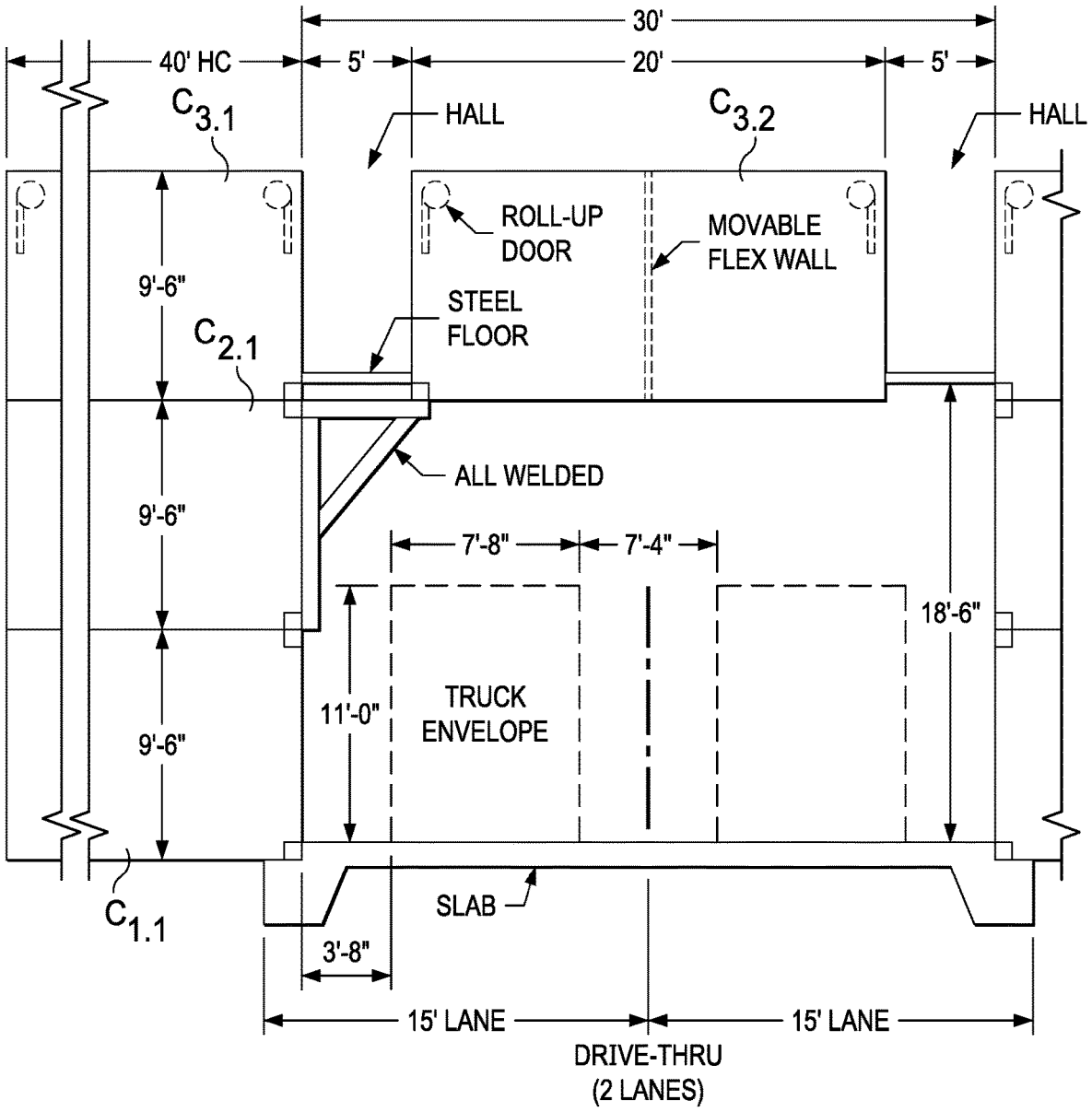
FIG. 6 illustrates sectional view of a design allowing drive-thru access through a self-storage facility built using containers, wherein support is provided for an elevated Level container via separate end support apparatus at each end of the elevated Level container.

FIG. 6 illustrates a "drive-thru" access aspect of a preferred embodiment self-storage facility. The Figure illustrates an opening of approximately 30'L that runs through a facility, from one end of the facility to another. The width of the drive-thru can be of varying dimensions, and is preferably at least 12'W to allow for one-way traffic. Drive-thru's of more than 24'W would allow for two-way traffic in the drive-thru. Although other self-storage facilities have drive-thru access, no current self-storage facility is known to utilize Containers to provide the ceiling of the drive-thru lane(s), or for structural support, to support an upper Level Container and/or an upper floor. For example, in FIG. 6 a truss-like support member is shown attached primarily to the Second Level Container 2.1 which has a vertical member attached (e.g., welded), preferably to the corner blocks of the Second Level Container, a horizontal member co-planar with the top of the Second Level Container, and an angled member between the vertical member and a distal end of the horizontal member, where all three members are affixed to one another, preferably via welding. Thus, the upper surface of the distal end of the horizontal member provides support for one end of a next higher Level Container C3.2, with it understood that the opposing end of that Container may be likewise supported by a comparable truss-like support member that is affixed to another Second Level container. By way of more specifics in these regards, FIG. 6 illustrates a 30'W×18'6"H drive-thru with a 20' NHCC used as the ceiling of the drive-thru. Structural steel supports will be welded or attached to the HCC on either side of the drive thru to support the 20' NHCC containers stacked along the length of the drive-thru. This preferred embodiment allows the largest retail moving trucks to have 2-way access in the drive-thru.

Figure 7A:
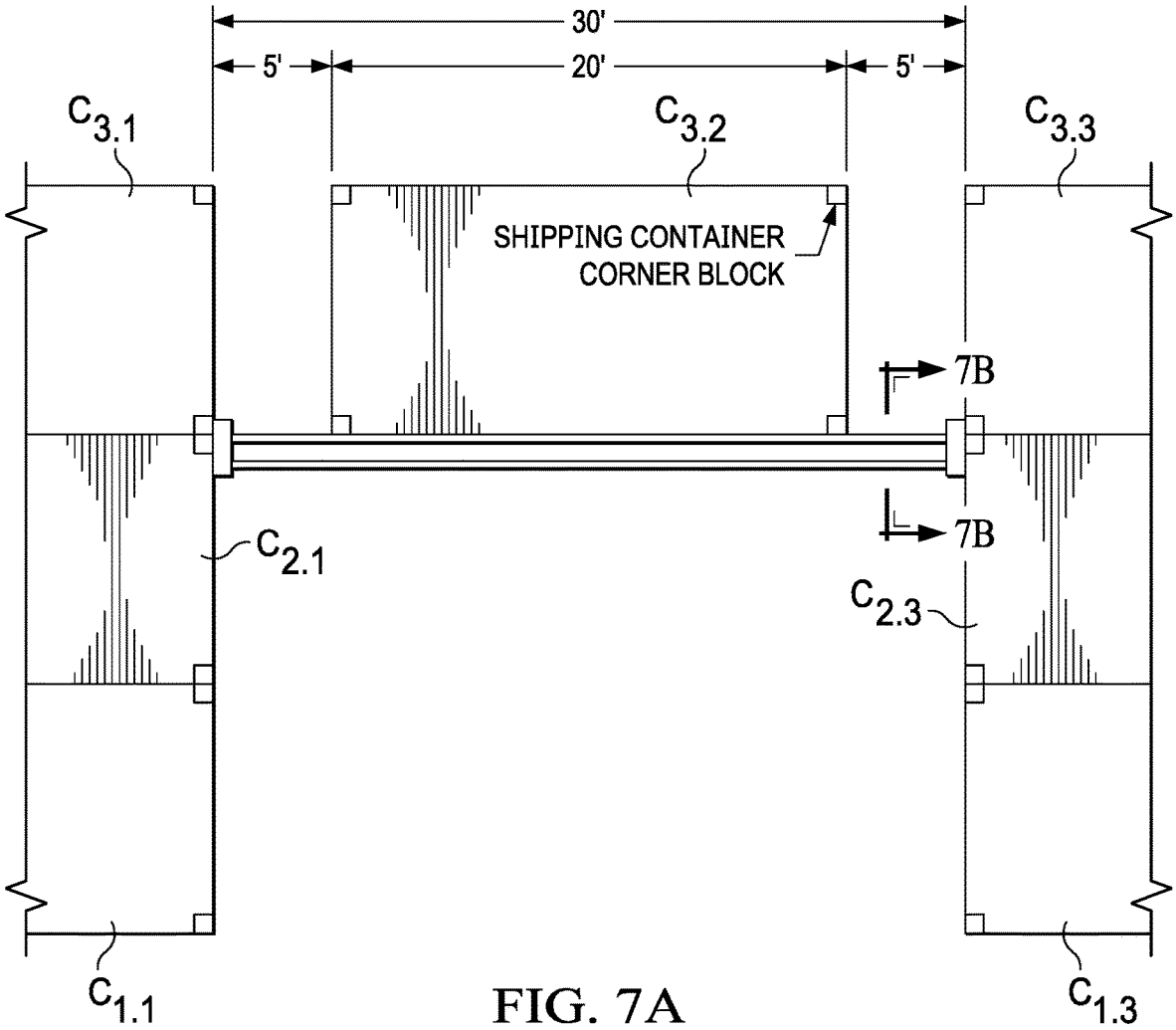
FIGS. 7A and 7B illustrates an alternative preferred embodiment to FIG. 6 to allow drive-thru access in a self-storage facility built using Containers, wherein support is provided for an elevated Level container via a pair of elongate (e.g., I-beam) members spanning the entire length of the elevated Level container.
Figure 7B:
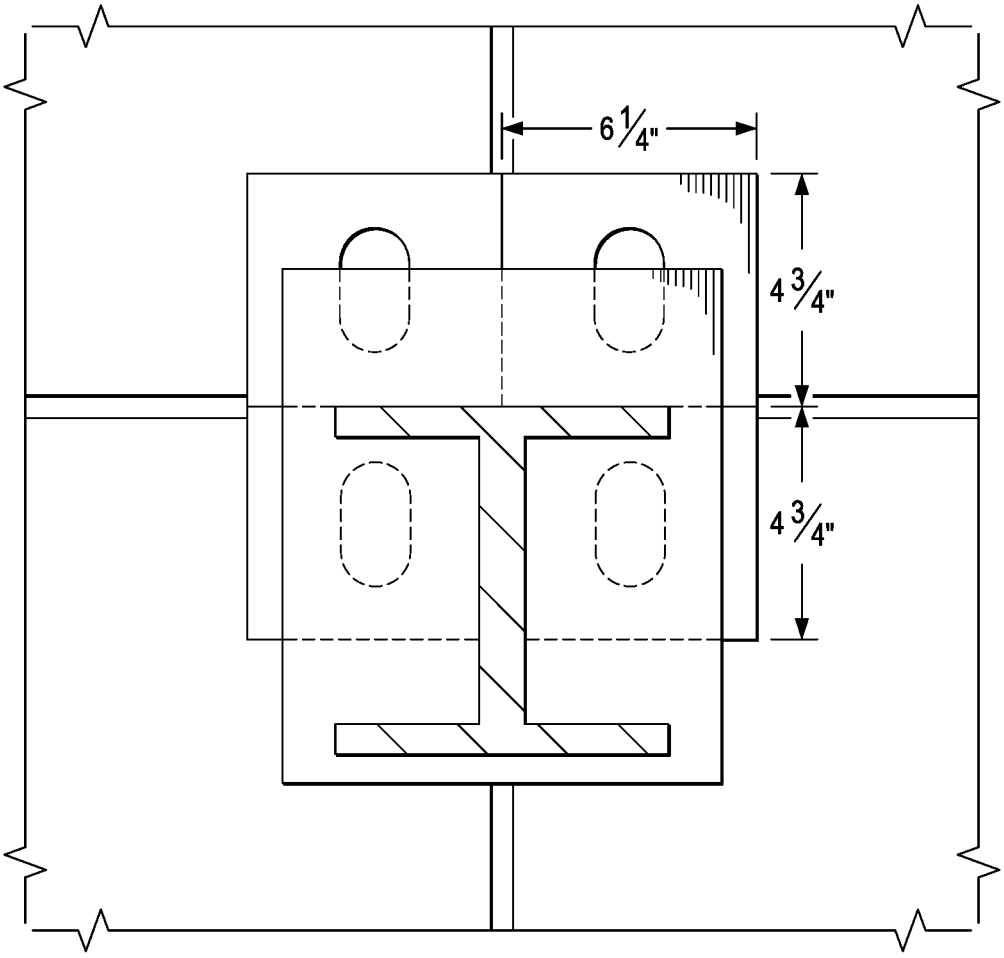

FIGS. 7A and 7B illustrates an alternative preferred embodiment to that of FIG. 6, where again a drive-thru is provided between First and Second Level Containers, and a Third Level Container is atop the drive-thru. In FIGS. 7A and 7B, however, instead of welding two truss-like structural supports to same Level (e.g., Second Level) Containers, two beams (e.g., I-beams) are placed at the joining of two corner blocks from the two 40' HCC sitting side-by-side on the Second Level of the facility, with the two corner blocks from the two 40' HCC sitting side-by-side on the Third Level. On each side of the drive-thru, a structural plate would be welded to all 4 of the joined corner blocks and then a structural beam would span part of the length of the drive-thru, whereby Container C 3.2 is positioned (and preferably affixed, such as via welding), the two beams. Note that each beam positioned as thus described, as shown at the bottom of FIG. 7B in cross section, may support a lower edge of a first Container to the left of the upper surface of the I-beam and at the same time may support a lower edge of a second Container to the right of the upper surface of the I-beam. In this manner, therefore, plural Third Level Containers may be positioned, each having its major axis parallel to one or more other Third Level Containers, above the drive-thru.

Figure 8:
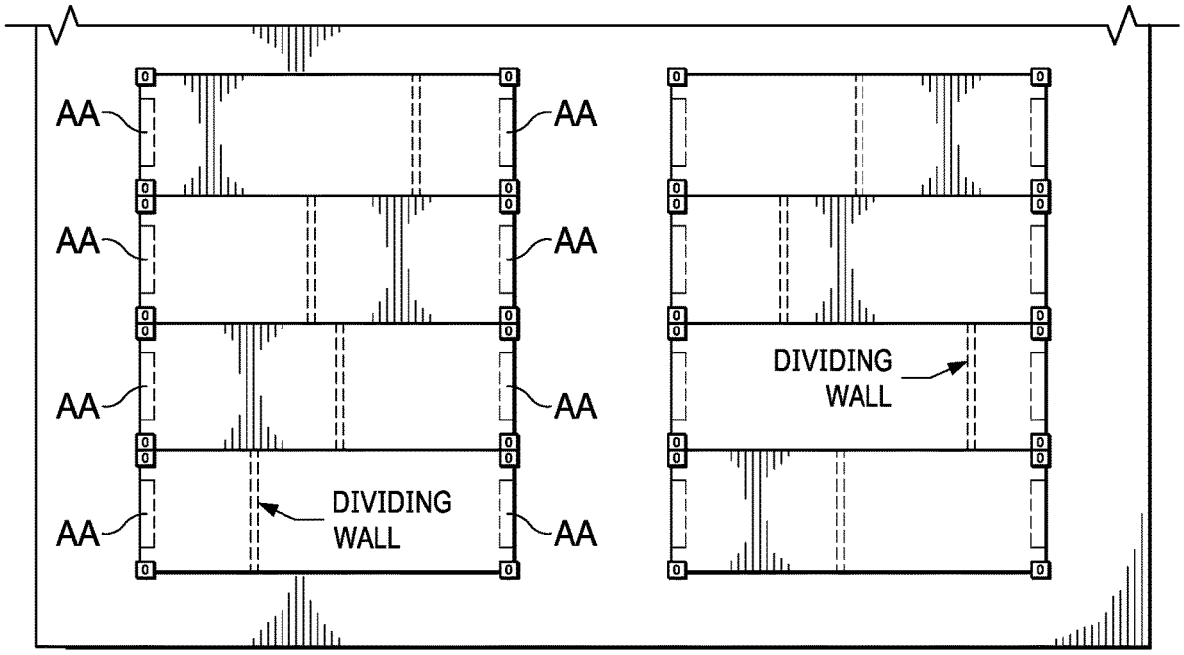
FIG. 8 illustrates a top view of a preferred embodiment with stacking containers having access apertures located only at each end of each container, and with a single (and preferably movable) dividing wall between the two ends of each container.
Figure 9:
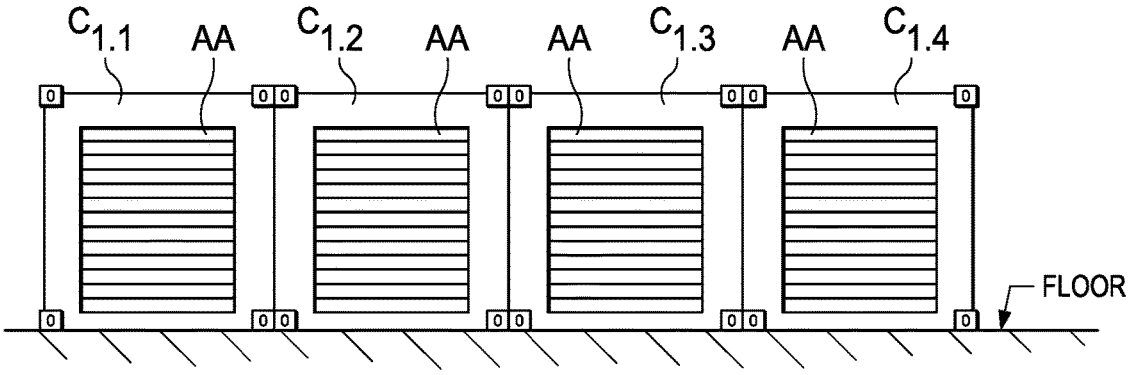
FIG. 9 illustrates an end view of FIG. 8.
Figure 13A:
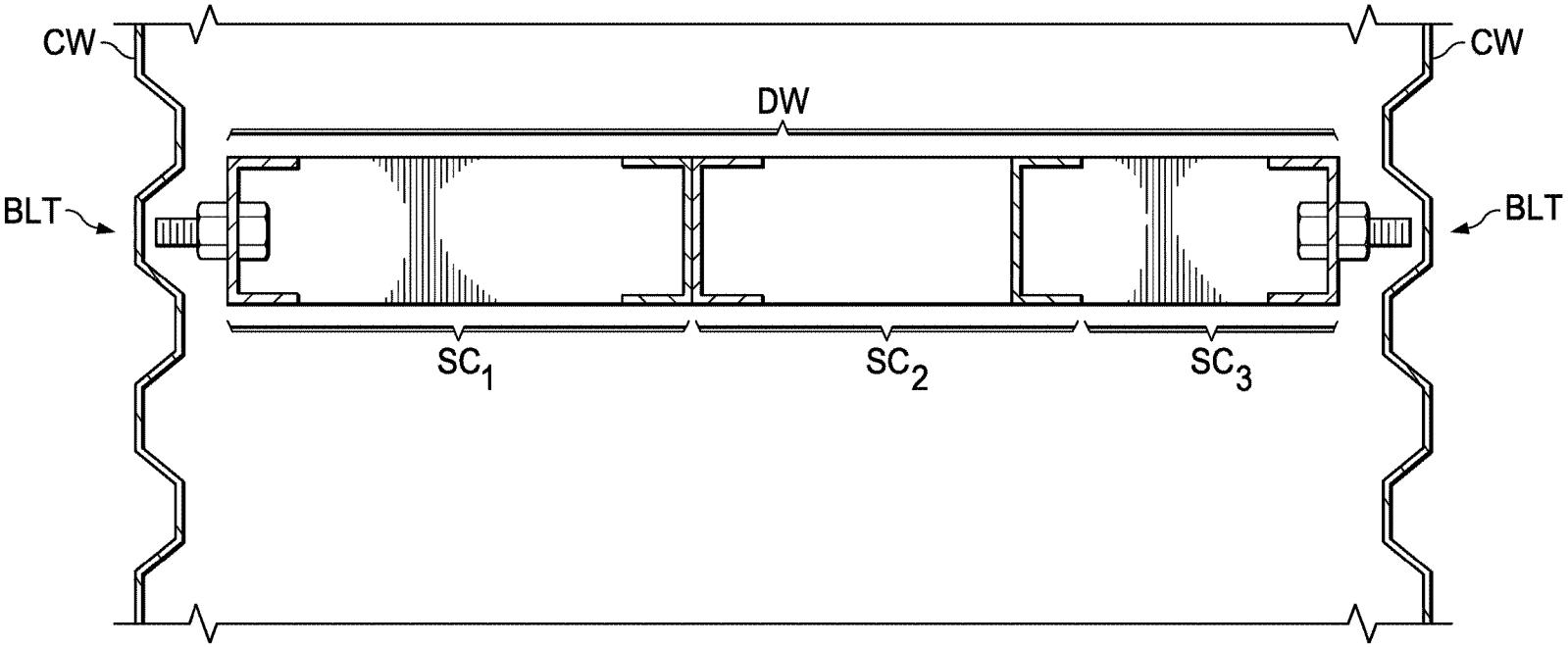
FIGS. 13A and 13B illustrates views of a movable dividing wall that may be added to the inside of a Container according to a preferred embodiment, and also that may be readily moved from time to time by alleviating the friction fitting mechanism (e.g., bolt tips), repositioning the wall, then reapply the friction fit force.
Figure 13B:
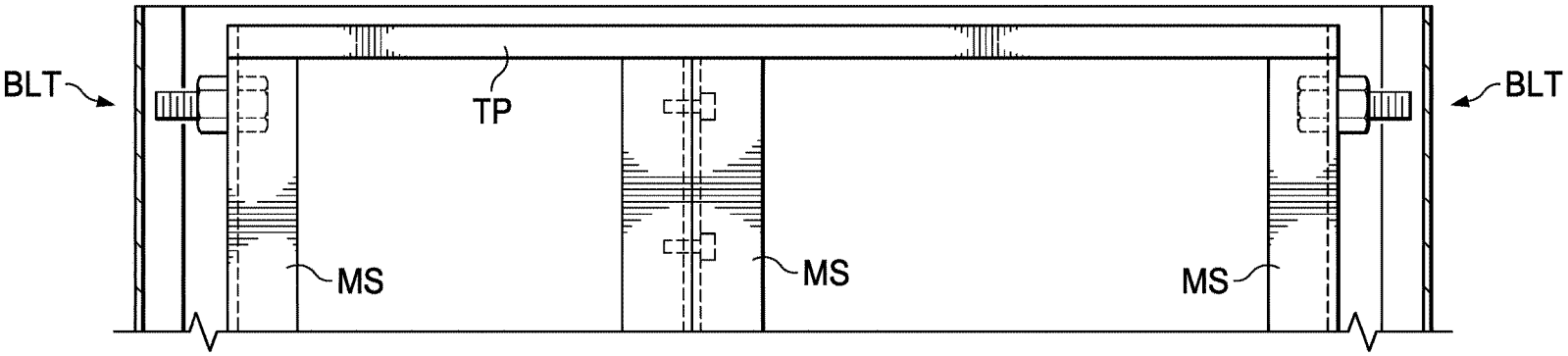

In another preferred embodiment for the placement and stacking of Containers in a self-storage facility, Containers are stacked in a manner in which a hallway floor runs along the ends of several Containers instead of along the length of the containers. FIG. 8 shows a plan view of eight Containers, where each Container has a single access aperture at each of its ends (for simplicity, only those apertures to the left are labeled with a legend), and also with each Container having a single Dividing Wall, which preferably is movable such as by having hardware that friction fits within the interior side of the sidewalls of each Container, where the friction fit may be positioned relative to the bends in the corrugated profile of those sidewalls. Moreover, preferably the friction fit is so that the fastener(s) (e.g., bolt tip or end) that imposes the friction fit does not penetrate the interior of the wall of the Container, and so that the friction may be temporarily reduced (e.g., by loosening the bolt), the wall re-located to another position, and the friction then re-instated (e.g., by tightening the bolt); various aspects in these regards are shown in FIGS. 13A and 13B. In this regard, therefore, the total volume of each Container is divided into two separate volumes, separated by a Dividing Wall, and each separate volume is accessible by its own respective access aperture AA and is also changeable at a later time by repositioning the Dividing Wall. Thus, in this preferred embodiment, a Container provides various benefits of its structural sturdiness and support, but is readily divided into a storage volume, and that volume can match or differ from other Containers at the same facility. In the example shown in FIG. 8, the total eight Containers are separated into sets of four Containers, where in a set each Container is parallel and proximate, or even having a sidewall touching, a respective Sidewall in another Container. Moreover, one set of Containers is separated by a distance from the other set, whereby that distance therefore represents a hallway between the two sets, where a Floor may be created in that hallway between a first end of each Container in one set with a first end of each Container in the other set. Although not shown in FIG. 8, additional Containers would be stacked directly on top of the Level of Containers shown, so as to provide two or more Levels of storage. FIG. 9 shows an end view of four of the FIG. 8 Containers stacked side by side, whereby the corner blocks of one Container abut with (and may be welded to) the corner blocks of at least one other Container. Access apertures AA are located on each end of the Container in this embodiment. Using only the ends of the Containers for access apertures is likely to drastically reduce cost to modify the Containers for use in a facility, as compared to preferred embodiment wherein access apertures are formed in a sidewall (as opposed to end or endwall) of the Container. The latter may include increase labor spent to cut door openings, install doors, paint the remaining side of the container, whereas access apertures solely on the Container ends may reduce labor and material costs to modify the Container by about 60%.

Figure 10A:
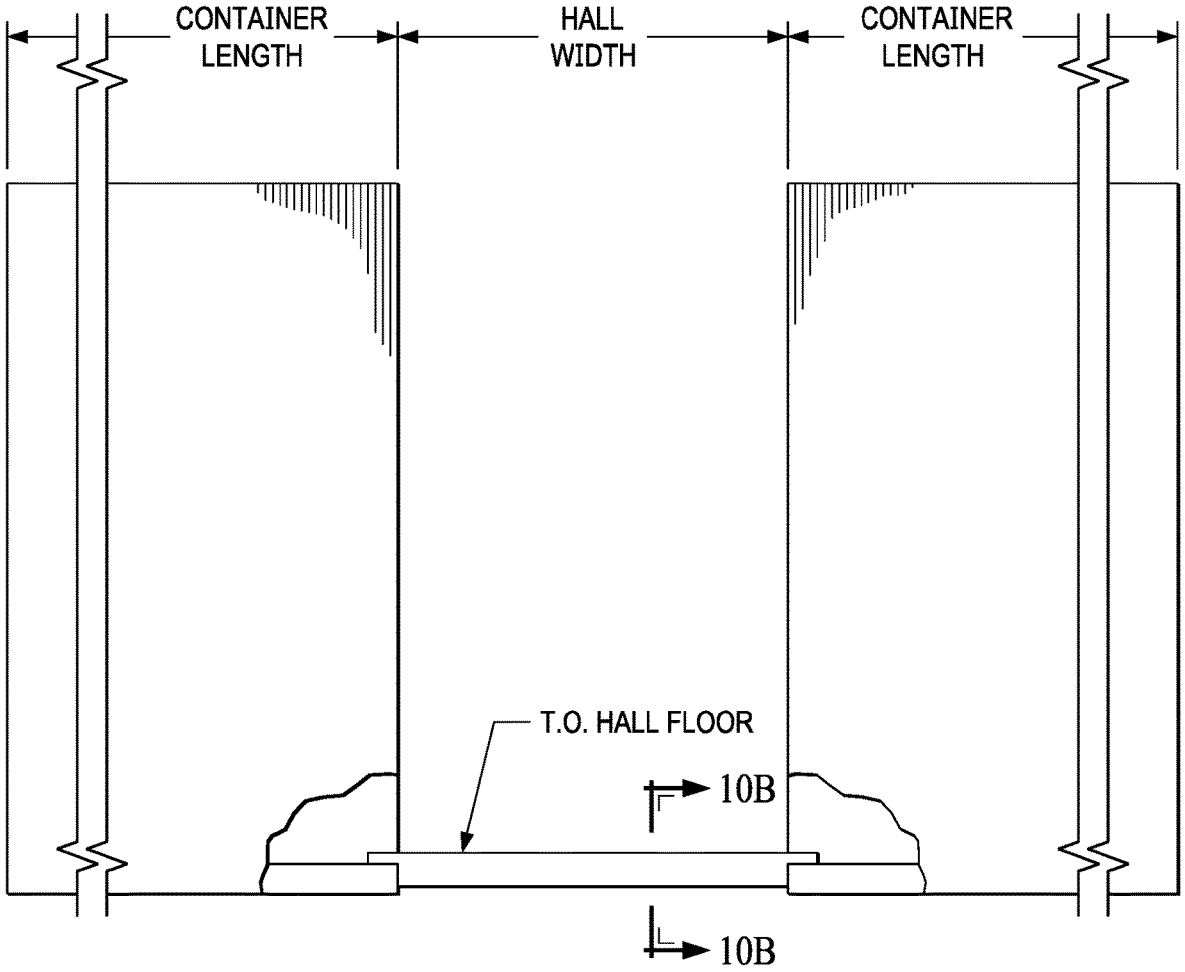
FIGS. 10A and 10B illustrates a sectional view of a preferred embodiment hallway floor extending between the ends of containers separated by a gap (e.g., hallway gap), wherein the floor abuts the top of the bottom end frame of each respective container.
Figure 10B:
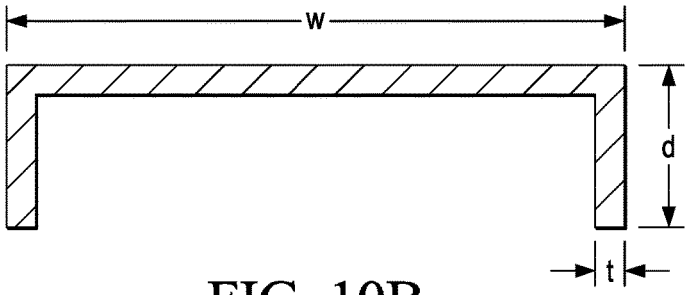

In another aspect, because the ends of the HCC and NHCC Containers do not have bottom side rails like the 40'L sides have side rails to the Container, a preferred embodiment further includes a floor that bridges between the ends of the different sets of Container and therefore across the hallway width, and that also spans the length of such hallway. FIGS. 10A and 10B display a 12"-36" bent metal plate (section A-A) in which the floor includes an upper flange that extends into the interior of each Container, at the end of the Container, where the bottom of the flange is positioned atop the Container floor or the end frame member of the Container. These sections are preferably installed as planks from one Container to the other, side-by-side, with the aggregate width of the planks spanning the length of the hallway and then covered with a suitable walking surface for customers like carpet, linoleum or a similar finish.

Because Containers comply with standard dimensions, and given the teachings of this document, one skilled in the art may readily find manners, potentially with or without additional apparatus, so as to stack, install, and orient the Containers, providing a short construction or installation period, as compared to that required in traditional self-storage facilities. Moreover, note that while not shown in FIG. 2, an additional Container may be to the left of the open floor area OFA and perpendicular to the Containers in FIG. 2, so as to define a perimeter wall above and along the far left end of Container $C_{1,3}$.

Further in a preferred embodiment, the Containers are installed in either a climate controlled environment, a covered non-climate controlled environment, outside, or a combination of two or three of these locations.

It is to be observed that various benefits are achieved by the preferred embodiment use of common commodity Containers. Their dimensions and load carrying capacities are controlled and uniform, providing a dependable, predictable, and stackable means of providing single-level or multi-level self-storage volume and facilities. Moreover, the Containers may be obtained already fitted, or be retrofitted, with multiple doors or other manners of access, with each container providing several individual self-storage units. Because of the preferred embodiment unique design and layout of the Containers, access to storage units are a combination of:

- The entire volume of a Container, or
- A partial volume of a Container (when walls are installed inside the Container), or
- A partial volume of several side-by-side Containers. For example if two 40 foot containers are situated side-by-side lengthwise, one storage unit could be the first 8' section of both Containers, accomplished by cutting out the walls of both units to allow access.

Further in a preferred embodiment, access to Containers located above the First Level (i.e., ground) is provided by an elevator (lift), stairs, ladder, or combination thereof.

In all events, from the above, the preferred embodiments provide an improved self-storage facility, fabrication, and methodology. Such embodiments, therefore, may provide numerous advantages over the prior art, particularly since such existing single level and multi-level self-storage facilities can be expensive to design and build. In contrast, the preferred embodiments provide:

- Quick, cost effective construction that can be completed in about half the time of traditional steel and concrete construction and for a significant reduction in cost.
- The Containers are not permanently attached to a floor, wall or ceiling (CLG, see FIG. 1), so they are not a part of real property and can be moved or relocated if desired.
- Does not require any structural build-out typical of multi-level construction such as structural beams, concrete, additional steel supports or any other structural build-out required to hold the weight of additional levels.

The specific configuration of the Containers can be changed to adapt to any specific building dimension.

This invention significantly increases the square feet of self-storage per square foot of building footprint because of the utilization of the self-storage Containers configured in this manner.

Figure 4A:
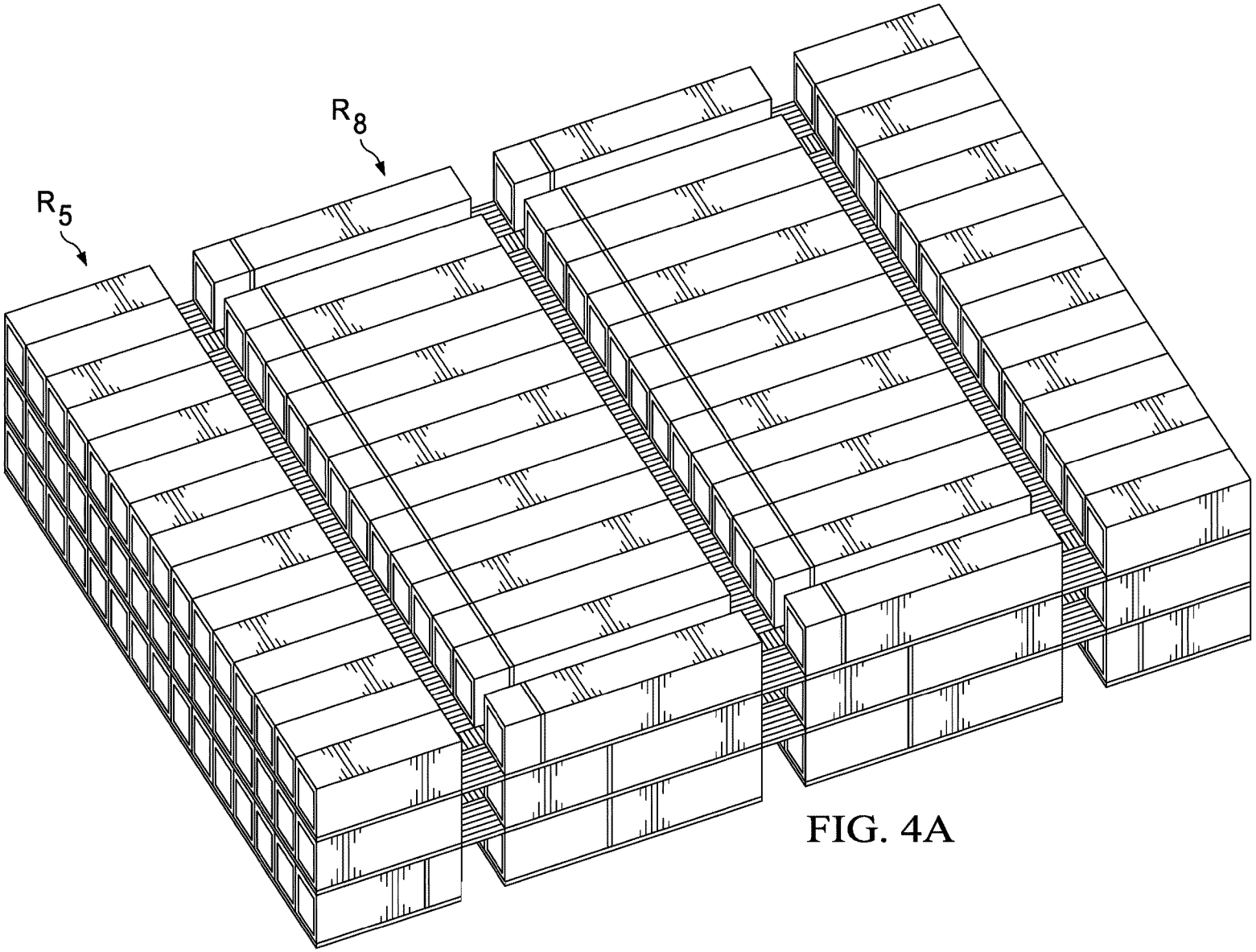
FIG. 4A illustrates a perspective view of a plurality of shipping containers, a majority of which are arranged with a respective major axis parallel to the major axis of other shipping containers, creating both First and Second Level storage in the facility and with various flooring illustrated between containers at a same elevated Level (e.g., Second and Third Levels).
Figure 4B:
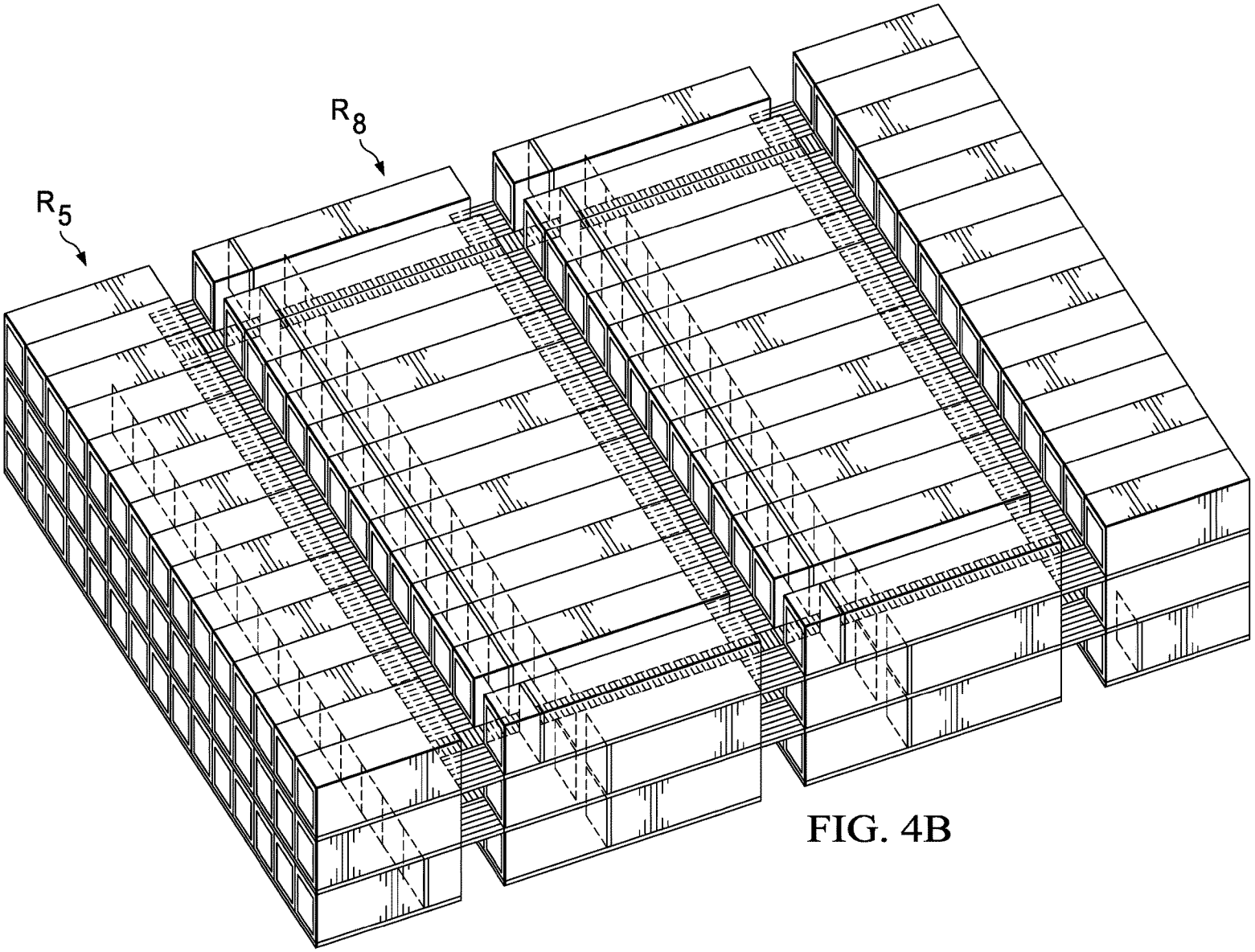
FIG. 4B is the same perspective view as FIG. 4A with the exception that a slight transparency is provided in the container walls in order to provide a perspective view into the interior of the containers.

FIG. 4A illustrates a perspective view of a plurality of shipping Containers, arranged with a respective major axis parallel to the major axis of other shipping containers, creating both First and Second Level storage in the facility. By way of example, therefore, to the back left of FIG. 4 is a first row $R_5$ of Second Level Containers with respective co-linear major axes, below which are additional supporting Containers that are not visible from the perspective view. The Containers depicted in FIG. 4A also have respective major axes aligned parallel to the axes of row $R_5$. Although not shown in FIG. 4A, an elevator and/or stairway access mechanism may be accessed from any level below. Further in this regard, the Containers in row $R_8$ may have their end walls removed (or a portion thereof), creating a Second Level hallway access to another aisle of Second Level Containers. FIG. 4B is the same perspective view as FIG. 4A with the exception that you can see into the Containers. From this perspective, the partition wall is shown inside dividing the Container into two storage units that can only be accessed from the ends of the Containers. As shown in FIG. 9, this configuration involves the removal of both ends of the Container, or portions thereof, and the installation of industry standard sliding or roll-up doors. Although Containers are modified in great numbers, including modifications using partitions within the Container, all such modifications include the ability to access the space on either side of the partition while inside the Container, typically using an access aperture or a simple opening in the partition. This unique design modifies the Container so that once inside the Container, one cannot access the other side of the partition.

Figure 4C:
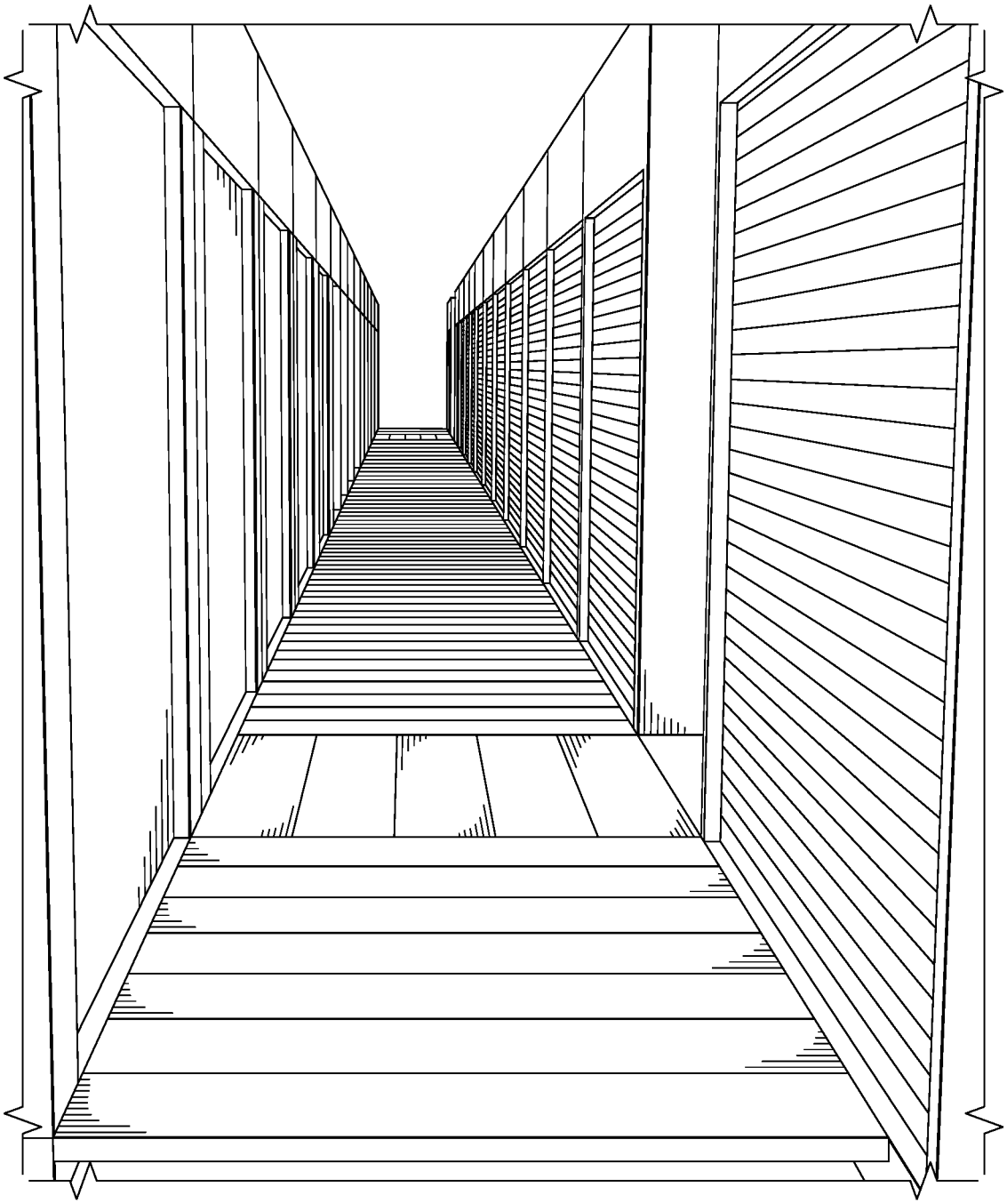
FIG. 4C illustrates an enlarged partial view of FIG. 4A, with a perspective that illustrates a Third Level hallway at the front left of FIG. 4A, whereby preferred embodiment flooring aspects are shown between ends of containers as well as from an end of a container toward a hallway between containers, whereby the latter is supported at one end from the end of a container and as the flooring extends toward the hallway is then supported between respective bottom rails of parallel containers.

FIG. 4C illustrates an enlarged partial view of FIG. 4A, with a perspective that illustrates the 3$^{rd}$ floor hallway at the front left of FIG. 4A. This Third Level hallway is shown as if a person walking along such a hallway is supported by the floor designed in FIGS. 10A and 10B. Also in this perspective, numerous access apertures AA are illustrated to depict respective entrances to storage unit areas formed within each Container, and walled apart from one another as detailed later.

Figure 11A:
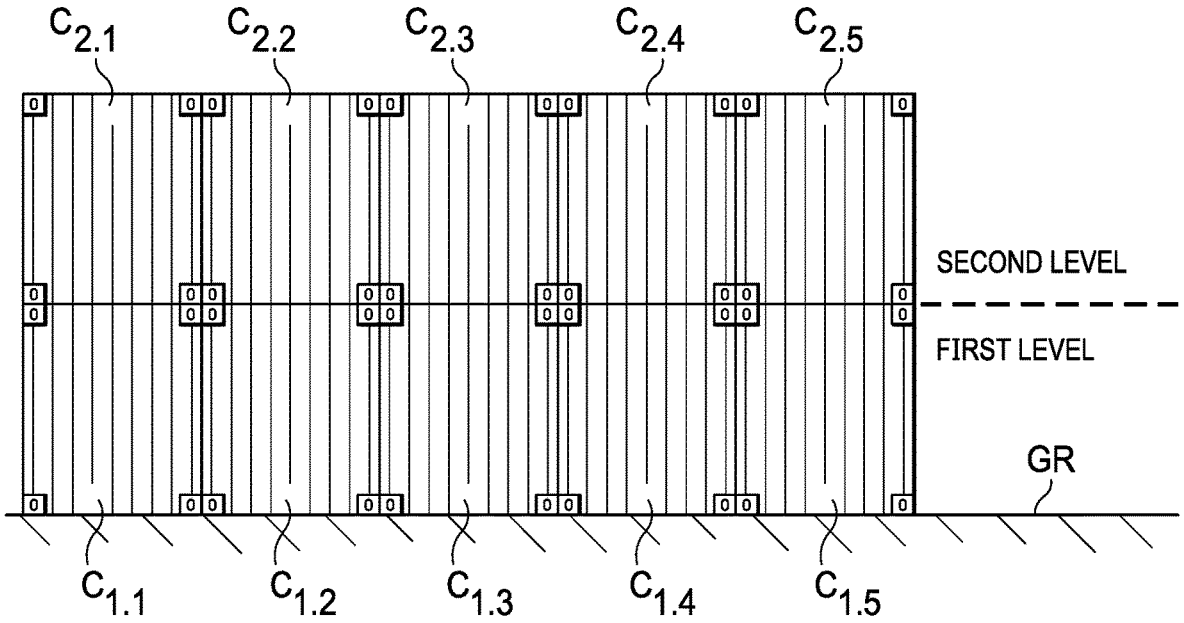
FIGS. 11A and 11B illustrate respective end and top views of a preferred embodiment for forming self-storage units (SSU) and hallways (HW) by stacking a number of Containers with the vertical walls of a Container in one level aligned with the vertical walls of a Container in a next higher level.
Figure 11B:
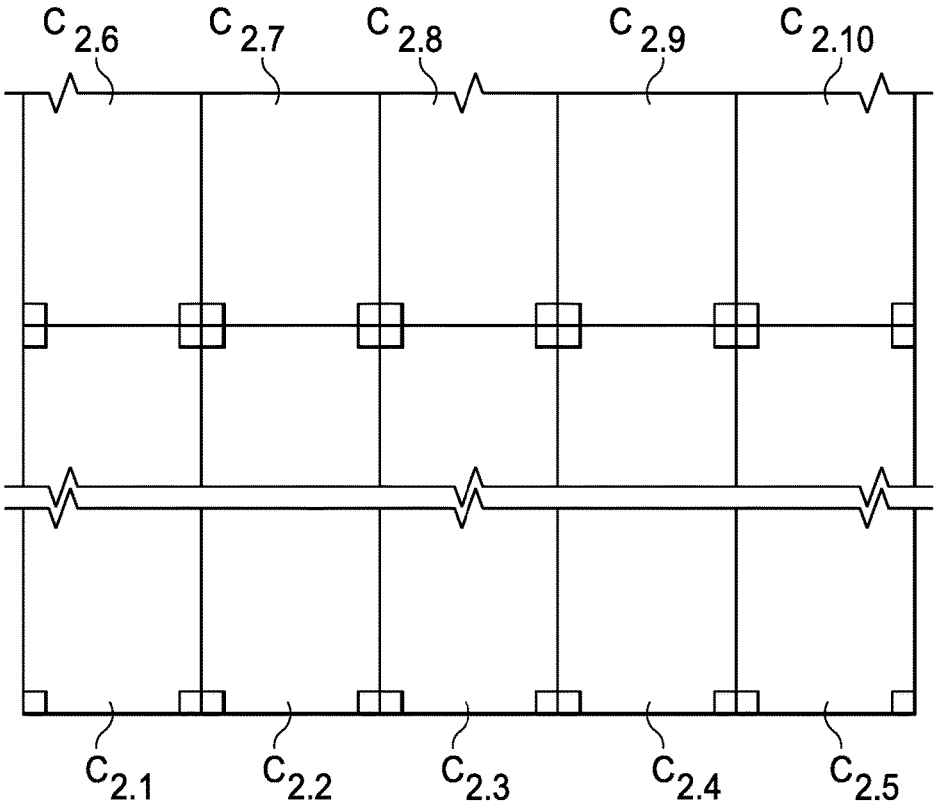

FIGS. 11A and 11B illustrate respective end and top views of this same embodiment for forming self-storage units (SSU) and hallways (HW) by stacking a number of Containers with the vertical walls of a Container in one level aligned with the vertical walls of a Container in a next higher level. As shown in FIG. 11A, therefore, a First Level of Containers is shown to include five Containers $C_{1.1}$ through $C_{1.5}$ atop a grade GR (such as the ground). Similarly, a Second Level of Containers is shown to include five Containers $C_{2.1}$ through $C_{2.5}$. Each Second Level Container has its vertical walls aligned in the same vertical plane as the First Level Container beneath it. Moreover, while FIG. 11A illustrates only two Levels of Container stacking, multiple additional levels may be added, such as up to five Levels or higher.

With the arrangement of FIGS. 11A and 11B, any Containers on a same Level and with their major axis aligned may be used to form either hallways HW or self-storage units (SSU), where to form a HW at least a majority portion of the end walls of the selected Containers along the hallway are removed (e.g., by cutting). For example, in the top view of FIG. 11B, Second Level Containers $C_{2.1}$ through $C_{2.5}$ are again shown, adjacent a second set of Second Level Containers $C_{2.6}$ through $C_{2.10}$. In this example, however, Containers $C_{2.3}$ and $C_{2.8}$ have their major axes aligned (i.e., along the major length of each Container), and it is desired to form a hallway HW along those axes. Accordingly, where Container $C_{2.3}$ adjacent Container $C_{2.8}$, a majority of the respective ends of each such Container in that vicinity are cut away, there forming a passage between what was the interior of Containers $C_{2.3}$ and Container $C_{2.8}$. Moreover, a portion of the side walls of Containers $C_{2.3}$ and Container $C_{2.8}$ are also cut away, thereby providing access to each Container to the left or right of the hallway Containers $C_{2.3}$ and $C_{2.8}$—thus, the sidewall cutaways of Container $C_{2.3}$ provide access from the interior of Container $C_{2.3}$ to either Container $C_{2.2}$ or Container $C_{2.4}$, and the sidewall cutaways of Container $C_{2.8}$ provide access from the interior of Container $C_{2.8}$ to either Container $C_{2.7}$ or Container $C_{2.9}$. Hence, Containers $C_{2.3}$ and $C_{2.8}$ form a hallway HW, while Containers to the sides of that hallway (i.e., Containers $C_{2.2}$, $C_{2.4}$, $C_{2.7}$, and $C_{2.9}$) remain as self-storage units SSU.

Figure 12:
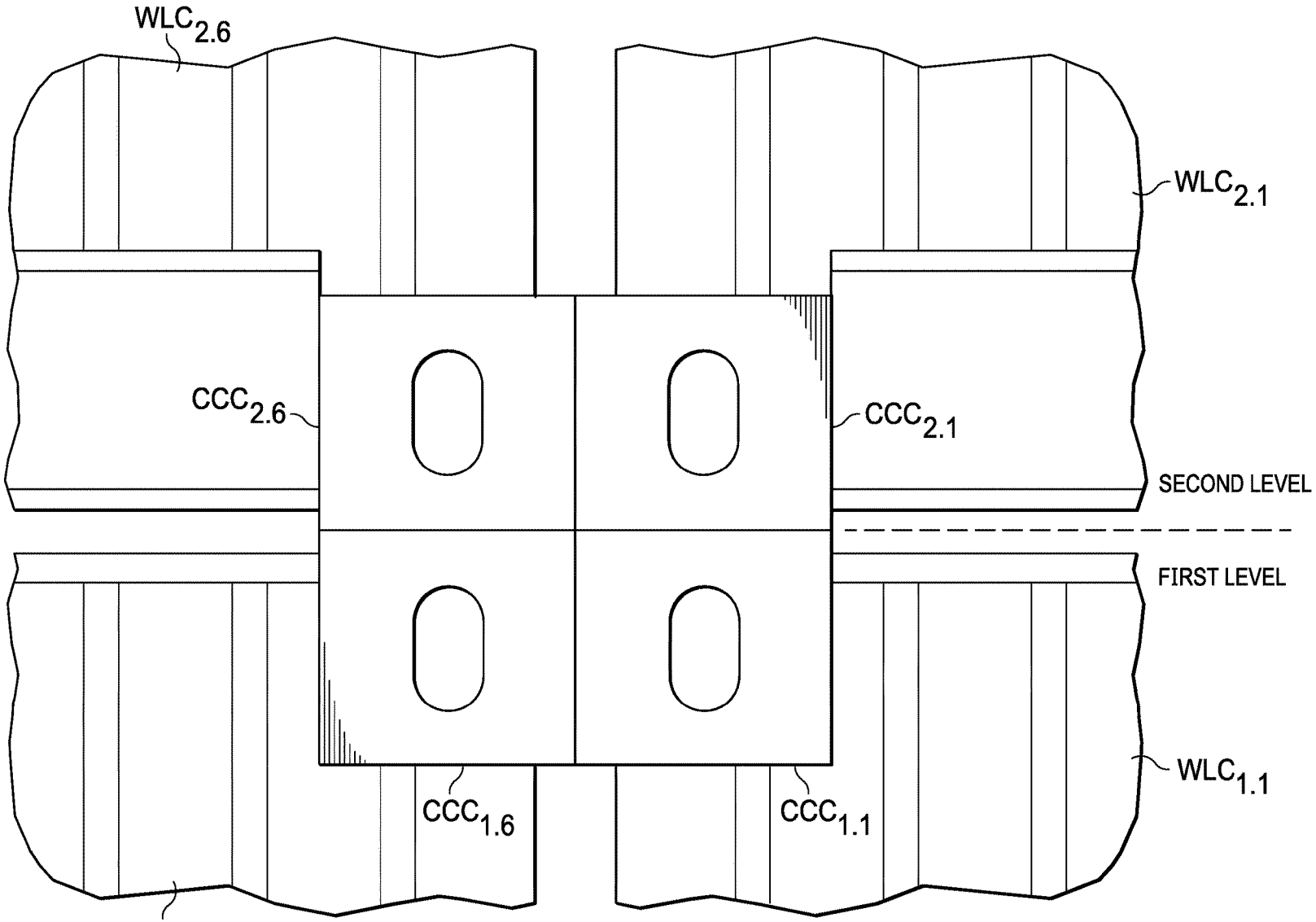
FIG. 12 illustrates a partial side view of the corrugated walls $WLC_{2.1}$ and $WLC_{2.6}$ and respective corner castings $CCC_{2.1}$ and $CCC_{2.6}$ of each of Containers $C_{2.1}$ and $C_{2.6}$ as Second Level Containers atop respective Containers $C_{1.1}$ and $C_{1.6}$ as First Level Containers below the Second Level Containers.

FIG. 12 illustrates a partial side view of the corrugated walls $WLC_{2.1}$ and $WLC_{2.6}$ and respective corner castings $CCC_{2.1}$ and $CCC_{2.6}$ of each of Containers $C_{2.1}$ and $C_{2.6}$ as Second Level Containers atop respective Containers $C_{1.1}$ and $C_{1.6}$ as First Level Containers below the Second Level Containers. Thus, each Container has a corner casting that abuts at least one casting corner of two other Containers.

Figure 14:
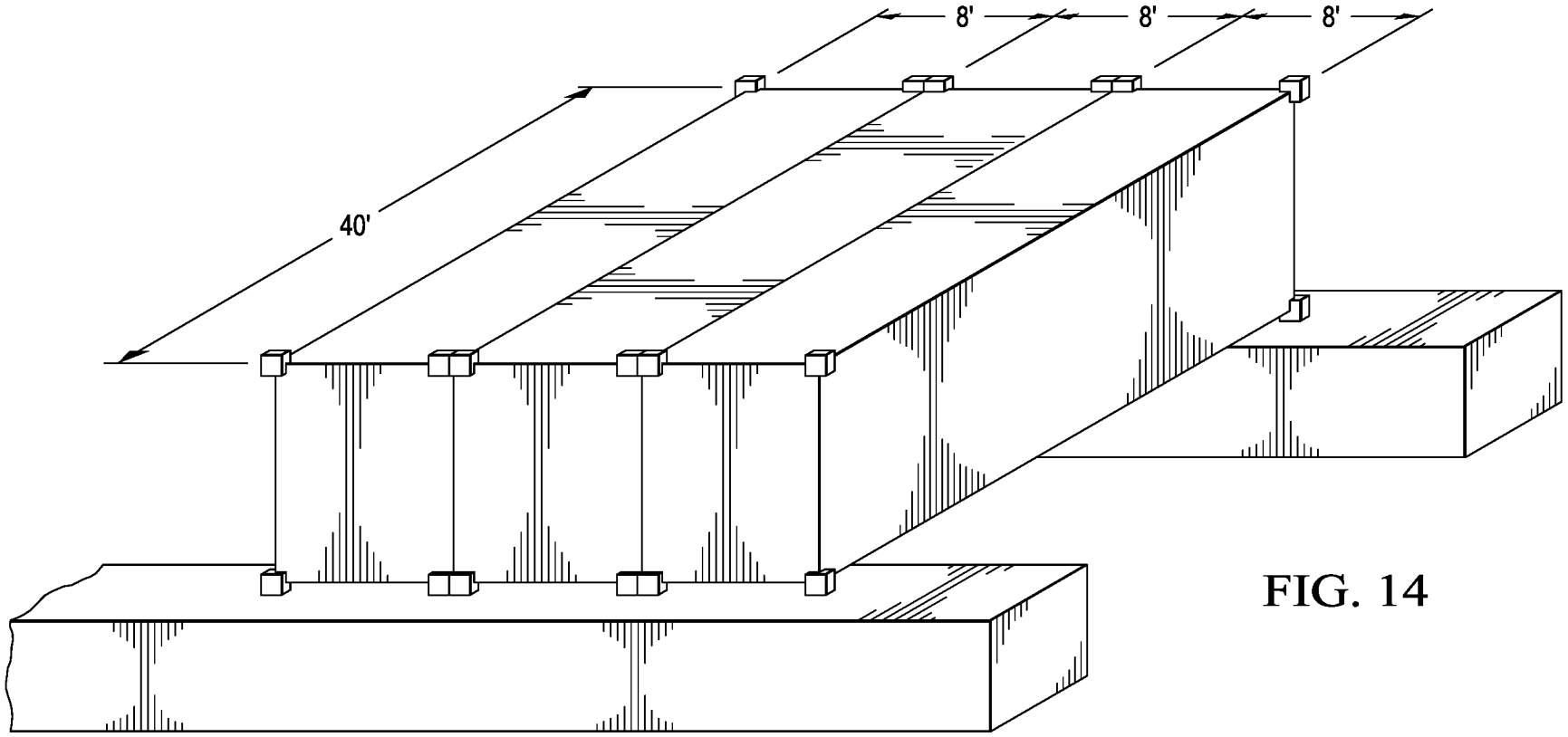

FIG. 14 illustrates a preferred embodiment for supporting the ends of Containers. Specifically, in this preferred embodiment, expense may be reduced in that an entire concrete slab is not required under all area beneath the Containers. Rather, due to the Container construction and the load support of its corner castings, in a preferred embodiment as illustrated in FIG. 14 strips of concrete are formed, such as in parallel trenches that align perpendicularly (or transverse) the majority axis of plural parallel-aligned Containers. Note that such concrete strips are preferably reinforced and will contain anchor bolts/embeds to which the containers corner castings will attach.

Having described numerous preferred embodiments and preferred embodiment aspects, the inventors respectfully expect to revolutionize the self-storage industry. Specifically, a number of Containers may be aligned in various fashions as described herein, whereby the Containers are typically 8 feet wide by 20 feet long or 40 feet long, and as noted above may have the same or differing heights. Note that the number of containers at a facility is preferably in the hundreds, where, for example, approximately 300 containers may be used to provide a 90,000 rentable square foot self-storage facility. These Containers are supported on different Levels either by concrete or by other Containers (or structure attached to other Containers), in such a way to produce, for example, a structure consisting of three Levels of Containers, each about 9.5 feet high, resulting in a structure of containers which is 28.5 high. Containers are positioned not only atop each other, as described above, but are also positioned end to end and side by side. The resultant footprint is approximately 45,000 to 50,000 square feet. Once the structure of Containers is assembled, traditional materials and methods may be used to weather-proof the facility. This may be accomplished via the use of girts, purlins, insulation, architectural sheet metal, glass, masonry and roofing sheet metal. The finished building is wired, plumbed and climate controlled in the same fashion as traditionally constructed self-storage facilities. Thus, upon completion, an entire self-storage facility is created where the facility may be skinned and/or have a ceiling (CLG, see FIG. 1), so as to produce an enclosed facility, with the enclosure housing and/or including a number of Containers. Moreover, some or all of the Containers have plural different storage spaces within the respective Container, by including within the Container one or more dividing walls, thereby segregating the inner volume of the Container, and where each separate volume has a single (or multiple) respective access aperture. As shown above, in one preferred embodiment, a large number of the facility Containers are configured in this regard to have a single interior wall, thereby dividing the Container volume into two (either equal or unequal) volumes, where an access aperture at each end of the Container provides access to a respective one of the two volumes. As also shown above, access apertures may be formed in the sidewall of a Container, or of course access apertures may be formed in either or both the Container sidewall(s) and the Container end(s). In all events, therefore, the preferred embodiment accomplishes an efficiently modular and scalable configuration, thereby lending to various different facilities and considerations, while all the way drastically reducing cost to construct (and potentially to customers to use/rent), while also eliminating a possible glut of commercial cargo Containers. The preferred embodiments are therefore demonstrated above to have various apparatus, steps, and benefits, as will be appreciated by one skilled in the art. Further, while the inventive scope has been demonstrated by certain preferred embodiments, one skilled in the art will appreciate that it is further subject to various modifications, substitutions, or alterations, without departing from that inventive scope. For example, while certain apparatus and steps have been provided, alternatives may be selected. Thus, the inventive scope is demonstrated by the teachings herein and is further guided by the following exemplary but non-exhaustive claims.

What is claimed is:

1. A storage facility, comprising:

a plurality of load-bearing containers located at a single facility, the plurality of load-bearing containers comprising a first level of containers and a second level of containers supported above and by the first level of containers;

at least one dividing wall within an interior of selected ones of the plurality of containers, thereby separating the interior into a plurality of storage volumes;

at least one access mechanism for each of the plurality of storage volumes;

a climate controlled enclosure comprising a skin and providing a volume around the plurality of load-bearing containers, wherein a majority of the volume is filled with containers in the plurality of load-bearing containers; and wherein the climate controlled enclosure further comprises a ceiling directly above and configured to shield an uppermost level of the plurality of load-bearing containers from environmental exposure.

2. The facility of claim 1 wherein the access mechanism comprises a door.

3. The facility of claim 1 wherein the access mechanism comprises a roll-up door.

4. The facility of claim 1 wherein each container in the plurality of containers:

a single dividing wall within an interior of the selected ones of the plurality of containers, thereby separating the interior into a first storage volume and a second storage volume; and an access mechanism for the first storage volume; and an access mechanism for the second storage volume.

5. The facility of claim 1:

wherein the plurality of containers comprises a first container and a second container, wherein a major axis of the first container is aligned parallel to a major axis of the second container; and wherein the first container comprises a first and second corner casting block welded to and abutting a first and second corner casting block of the second container.

6. The facility of claim 1:

wherein the plurality of containers comprises a first container and a second container, wherein a major axis of the first container is aligned parallel to a major axis of the second container; and wherein the first container comprises a first and second corner casting block spaced apart from a first and second corner casting block of the second container, thereby forming a hallway area between the first container and the second container.

7. The facility of claim 6 and further comprising flooring along the hallway.

8. The facility of claim 7 wherein the flooring comprises members spanning between and physically attached to a lower area of the first and second containers.

9. The facility of claim 7 wherein the flooring comprises members spanning between respective bottom edge rails of the first and second containers.

10. The facility of claim 1 wherein the plurality of load-bearing containers located at a single facility comprising multiple levels of containers, wherein each level is located at a different height from one or more other levels.

11. The facility of claim 10 and further comprising a drive through beneath one of the levels of containers.

12. The facility of claim 10 wherein a first group of the plurality of containers, in a level of containers, comprises a first absolute container height, from a bottom of a container in the first group to a top of the container in the first group, and wherein a second group of the plurality of containers, in the level of containers, comprises a second absolute container height, from a bottom of a container in the second group to a top of the container in the second group, differing from the first height.

13. The facility of claim 12 and further comprising spacing members between containers of the first group so as to align a bottom edge of containers in the first group at a same horizontal plane as a bottom edge of containers in the second group.

14. The facility of claim 1 wherein the plurality of load-bearing containers located at a single facility comprise at least 100 containers.

15. The facility of claim 1 wherein the plurality of load-bearing containers located at a single facility comprise at least 300 containers.

16. The facility of claim 1 wherein different ones of the selected ones of the plurality of containers are divided by respective dividing walls into different sized plurality of storage volumes relative to other ones of the selected ones of the plurality of containers divided by respective dividing walls.

17. The facility of claim 1 wherein the skin comprises a plurality of external walls around a perimeter of the plurality of load-bearing containers.

18. The facility of claim 1 wherein the plurality of load-bearing containers further comprises a third level of containers supported above and by the second level of containers.

19. The facility of claim 18:

wherein each container in a majority of the first level of containers has two sidewalls and two end walls vertically coplanar with two respective sidewalls and two respective end walls of a container in the second level of containers; and wherein each container in a majority of the second level of containers has two sidewalls and two end walls vertically coplanar with two respective sidewalls and two respective end walls of a container in the third level of containers.

20. The facility of claim 1 wherein each container in a majority of the first level of containers has two sidewalls and two end walls vertically coplanar with two respective sidewalls and two respective end walls of a container in the second level of containers.

* * * * *